US009534463B2

(12) United States Patent
Frazier

(10) Patent No.: US 9,534,463 B2
(45) Date of Patent: Jan. 3, 2017

(54) PUMP DOWN TOOL

(71) Applicant: W. Lynn Frazier, Corpus Christi, TX (US)

(72) Inventor: W. Lynn Frazier, Corpus Christi, TX (US)

( * ) Notice: Subject to any disclaimer, the term of this patent is extended or adjusted under 35 U.S.C. 154(b) by 496 days.

(21) Appl. No.: 13/987,593

(22) Filed: Aug. 13, 2013

(65) Prior Publication Data

US 2015/0047827 A1 Feb. 19, 2015

Related U.S. Application Data

(60) Provisional application No. 61/795,104, filed on Oct. 9, 2012.

(51) Int. Cl.
*E21B 23/10* (2006.01)

(52) U.S. Cl.
CPC ..... *E21B 23/10* (2013.01)

(58) Field of Classification Search
CPC E21B 33/1265; E21B 33/129; E21B 33/1291; E21B 33/1292; E21B 33/1295
See application file for complete search history.

(56) References Cited

U.S. PATENT DOCUMENTS 2,644,523 A 3/1949 Brown
3,100,537 A * 8/1963 Crowe ..... E21B 49/087 166/133
3,346,045 A 10/1967 Knmapp
3,467,196 A 9/1969 Kinsman
4,018,272 A * 4/1977 Brown ..... E21B 33/1295 166/119
4,356,865 A 11/1982 Appel
4,392,528 A 7/1983 Paulson
4,423,783 A 1/1984 Haag
4,828,291 A 5/1989 Mitchell
4,961,465 A 10/1990 Brandell
5,018,579 A * 5/1991 Braddick ..... E21B 33/16 166/153
5,095,980 A 3/1992 Watson
5,180,009 A 1/1993 Sneed
5,209,304 A 5/1993 Nice
5,927,402 A 7/1999 Benson
6,138,764 A 10/2000 Scarsdale
6,250,387 B1 * 6/2001 Carmichael ..... E21B 21/002 166/229
6,460,616 B1 10/2002 Simpson
6,467,541 B1 10/2002 Wells
6,739,391 B2 5/2004 McMahan
6,973,971 B2 12/2005 Sebree
7,025,142 B2 4/2006 Crawford
7,182,135 B2 2/2007 Szarka
(Continued)

*Primary Examiner* — William P Neuder
(74) *Attorney, Agent, or Firm* — G. Turner Moller

(57) ABSTRACT

A pump down tool includes a resilient cup on the tool exterior to minimize leakage of pumped fluid around the outside of the tool when the tool is pumped into a well. The resilient cup is concave toward an upper end of the tool so it expands upon application of pressure to pump the tool into the well. The resilient cup is capable of expanding to a diameter sealing against the inside of the casing string. A fluid bypass around the resilient cup allows a fraction of the pumped fluid to stir up any proppant lying in the path of the tool thereby allowing the tool to move through a horizontal well without having to plow through the proppant.

18 Claims, 1 Drawing Sheet

(56) References Cited

U.S. PATENT DOCUMENTS

| | | | | |
|---|---|---|---|---|
| 7,261,153 | B2 | 8/2007 | Plump | |
| 7,322,421 | B2 | 1/2008 | Blacklaw | |
| 7,434,627 | B2 | 10/2008 | Turley | |
| 7,686,092 | B2 | 3/2010 | Szarka | |
| 7,753,130 | B2 | 7/2010 | Cote | |
| 8,079,413 | B2 | 12/2011 | Frazier | |
| 2005/0241824 | A1 | 11/2005 | Burris | |
| 2010/0155050 | A1* | 6/2010 | Frazier | E21B 33/12 166/102 |
| 2010/0263876 | A1 | 10/2010 | Frazier | |
| 2011/0277989 | A1 | 11/2011 | Frazier | |
| 2012/0118561 | A1 | 5/2012 | Frazier | |
| 2012/0145379 | A1 | 6/2012 | Frazier | |
| 2013/0264056 | A1 | 10/2013 | Stout | |

* cited by examiner

PUMP DOWN TOOL

This application is based on Provisional Application Ser. No. 61/795,104, filed Oct. 9, 2012, priority of which is hereby claimed.

This invention relates to a well tool that may be pumped into a well and more particularly to an improved tool that requires a smaller volume of liquid to pump the tool to its desired location.

BACKGROUND OF THE INVENTION

There are a number of situations in hydrocarbon wells where it is necessary or desirable to position a tool at a predetermined location in the well. In vertical wells, tools are conventionally run on the bottom of a wire line and use gravity to cause the tool to fall into the well. In horizontal wells, gravity can be used in the vertical leg but only for a very short distance into the horizontal leg. It has become customary to pump the tool on the end of a wire line to its desired location in the horizontal leg of a well. Pumping a liquid into the pipe string creates a dynamic pressure differential across the tool thereby propelling it along the horizontal leg. Because the tool is on the end of a wire line, the distance the tool is pumped can be controlled.

One problem with this approach is that substantial quantities of the pumped liquid, which is usually raw or treated water, are needed because creating a dynamic pressure drop across the tool requires that a large volume of liquid be pumped across the tool. It is not surprising to require twenty barrels of water a minute to propel a tool at an appropriate velocity in the horizontal leg of a hydrocarbon well. The volume required to pump the tool to its desired location is a simple multiplication of the pump rate and the pump time. It is not unusual to consume many hundreds of barrels of water to propel a tool a substantial distance in the horizontal leg of a hydrocarbon well.

A conventional approach is to provide a more-or-less rigid pump down collar on the exterior of pump down tools as shown in U.S. Printed Patent Applications 20100263876; 20110277989; 20120118561 and 20120145379 to reduce the gap between the outside of the tool and the inside of the pipe string.

Other disclosures of some interest relative to this invention are found in U.S. Pat. Nos. 2,644,523; 3,346,045; 3,347,196; 4,356,865; 4,392,528; 4,423,783; 4,828,291; 4,961,465; 5,095,980; 5,180,009; 5,209,304; 5,927,402; 6,138,764; 6,460,616; 6,467,541; 6,739,391; 6,973,971; 7,025,142; 7,182,135; 7,261,153; 7,322,421; 7,434,627; 7,686,092 7,753,130 and 8,079,413 and U.S. Printed Patent Application 20050241824.

SUMMARY OF THE INVENTION

As used herein, upper refers to that end of the tool that is nearest the earth's surface, which in a vertical well would be the upper end but which in a horizontal well might be no more elevated than the opposite end. Similarly, lower refers to that end of the tool that is furthest from earth's surface as measured along the well bore. Although these terms may be thought to be somewhat misleading, they are more normal than the more correct terms proximal and distal ends.

As disclosed herein, a pump down tool includes a resilient cup on the bottom of the tool that is captivated between a tool body and an anti-rotation device on the extreme bottom end of the tool. The tool body may include a stub having threads extending from its end terminating short of the junction between the stub and the larger tool body. The anti-rotation device may thread onto or slide onto the stub short of the tool body at a position captivating the resilient cup. In some embodiments, the cup may move axially between one position more-or-less abutting the tool body and a second position more-or-less abutting the anti-rotation device.

It is an object of this invention to provide an improved pump down tool requiring a smaller volume of water to propel the tool to its desired location.

Another object of this invention is to provide an improved pump down tool incorporating a resilient cup captivated between the tool body and an anti-rotation device on the bottom of the tool.

These and other objects and advantage of this invention will become more fully apparent as this description proceeds, reference being made to the accompanying drawings.

DETAILED DESCRIPTION OF THE INVENTION

Figure 1:
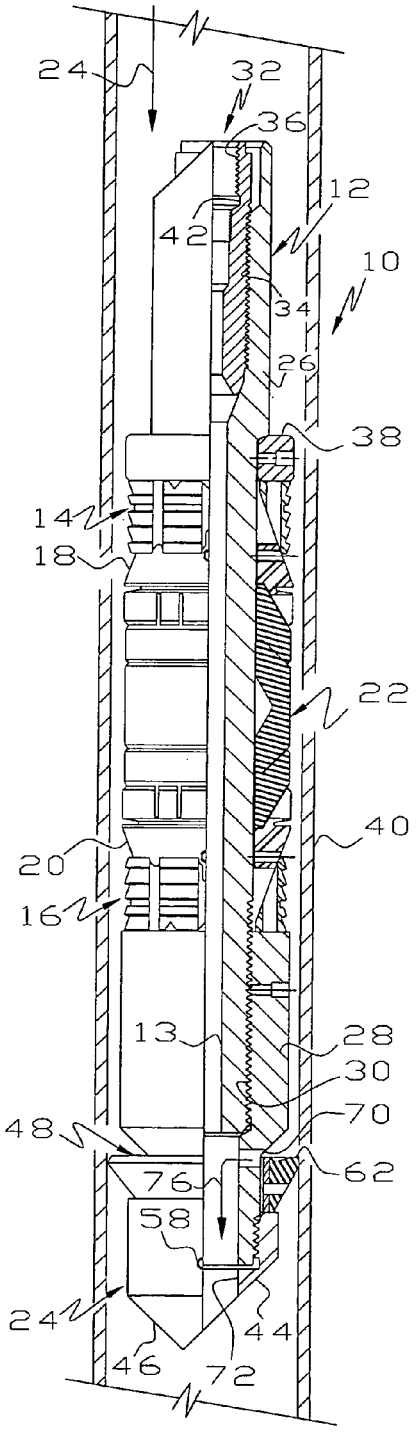
FIG. 1 is a partial vertical cross-sectional view of a pump down tool.
Figure 2:
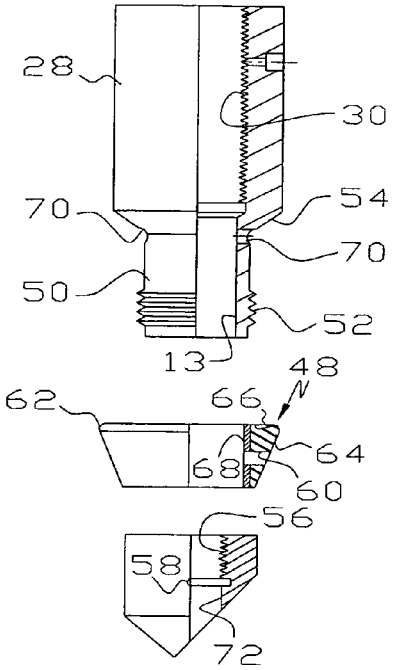
FIG. 2 is an exploded partial view of a resilient cup and its support from FIG. 1.

Referring to FIGS. 1-2, a pump down tool 10 may comprise, as major components, a body 12 having a passage 13 therethrough, one or more sets of slips 14, 16, one or more conical or wedge-shaped sections 18, 20, a malleable, rubber, packing element or seal 22 and an anti-rotation device or mule shoe 24. The body 12 may include an upper section 26 and a lower section 28 connected together in a suitable manner, such as by threads 30. The tool 10 is illustrated as of a type that can be converted between a bridge plug, a flow back plug, a check valve plug or otherwise by installing or removing a component in an insert 32. The component may be a plug, a valve ball, a soluble ball or the like as shown in U.S. patent application Ser. No. 12/317,497, filed Dec. 23, 2008, the disclosure of which is incorporated herein by reference.

The insert 32 may be attached to the upper body 26 by suitable threads 34 and may include internal threads 36 for connection to a conventional setting tool (not shown) connected to a wire line or other work string extending to the surface. The setting tool (not shown) may act in a conventional manner by pushing down on the top of a collar 38 and pulling up on the threads 36. This shears a pin (not shown) and allows the collar 38 to move downward relative to the slips 14, 16 thereby expanding the slips 14, 16 into gripping engagement with the casing 40.

The slips 14, 16, the wedges 18, 20 and the packing element 22 may be of a conventional type as shown in U.S. patent application Ser. No. 12/317,497, filed Dec. 23, 2008 so the tool is set in a conventional manner. During setting of the tool 10, the slips 14, 16 ride along the wedges 18, 20 to expand the slips 14, and fracture them into a number of segments in gripping engagement with the interior of a casing string 40 which may be cemented in a well bore (not shown). At the end of the setting of the tool 10, the insert 32 fails or breaks at a neck 42 thereby detaching the threads 36 and the setting tool (not shown) so the setting tool and wire line may be removed from the well.

The anti-rotation device 24 acts to minimize or prevent rotation of the tool when it is being drilled up by interacting with a subjacent tool. This may be accomplished in a number of ways, one of which is to provide angled faces 42, 44 on the bottom of a body 46 of the anti-rotation device 24.

There comes a time when it may be necessary or desirable to drill up the tool 10. Thus, many of the components of the tool 10 may be easily drillable such as composite materials, aluminum, brass and the like although slips 14, 16 are often cast iron. The slips 14, 16 normally fracture into small pieces which are more easily removable and don't necessary have to be drilled up. Those skilled in the art will recognize the tool 10 as heretofore described as being more-or-less conventional.

A resilient cup 48 may be part of the tool 10 adjacent a lower end thereof and may be captivated between the body 12 and the anti-rotation device 24. A preferred embodiment of the cup 48 may be a commercially available swab cup of a diameter matched with the I.D. or O.D. of the casing string 40. In other words, for use in 4½" casing, a swab cup of that size may preferably be used on the tool 10.

It may be preferred to captivate the cup 48 between the anti-rotation device 24 and the body 12. To this end, the lower body section 28 may include a stub 50 of reduced size providing threads 52 which terminate well short of a flared end 54 of the lower body section 28. The anti-rotation device 24 may include threads 56 received on the threads 52 and stopping at a distance from the flared end 54 greater than the thickness of the cup 48. In this manner, the cup 48 may be free to move slightly along the stub 50 so there is no requirement for an exact dimensional tolerance between the anti-rotation device 24, the lower body section 28 and the cup 48. A set screw 58 may be used to prevent the anti-rotation device 24 from unthreading from the stub 50.

In the alternative, the anti-rotation device 24 may slip over the stub 50 and be pinned in place to captivate the cup 48. Similarly, the cup 48 may be attached to the stub 50, or to the anti-rotation device 24, in any suitable manner, as by extending a fastener (not shown) through a passage 60 in the cup 48.

The resilient cup 48 may typically be made of rubber or similar elastomeric material and is sufficiently flexible so a lip 62 stays more-or-less in contact with the interior of the casing string 40 when the tool 10 is horizontal and the lip 60 is distorted by the weight of the tool 10 resting on its side. It will be seen that the lip 62 is formed from converging sides 64, 66 so that pressure from above spreads the lip 62 into a more secure engagement with the interior of the casing string 40. Many conventional swab cups include a metal reinforcing rim 68 and such features do not detract from operation of the cup 48 for present purposes. The cup 48 may be concave toward the upper end of the tool 10 so that pressure applied from above may spread or enlarge the diameter of the cup 48 from a size approximating the diameter of the tool 10 in its running in configuration to a size larger than the set diameter of the slips 14, 16.

There is an advantage of the cup 48 being on or near the bottom of the tool 10 rather than on the top. If the cup 48 were above the slips 14, 16 and the tool 10 were to strike an obstruction while moving through the casing 40, there is a risk that the shear pin (not shown) will shear off and the tool 10 will set prematurely at a location where it is not wanted.

When going into the vertical leg of a well, where the tool may be falling by gravity, the resilient cup 48 may abut the inside of the casing 40 but the flexibility and orientation of the resilient lip 62 allows liquid to bypass the resilient cup 48 on its exterior. In other words, the lip 62 may not substantially impede falling of the tool 10 in the vertical leg of a well. In this manner, the tool 10 may fall into the well in much the same manner that a swab falls into a vertical well.

One of the problems with the prior art devices is that when the tool is horizontal, it is eccentric to the casing, meaning that the gap between the tool and the casing becomes very large on the non-weight bearing side of the tool. This reduces the efficiency of the tool, meaning that a higher pump rate is required to produce the necessary dynamic pressure differential to pump the tool through the horizontal leg of a well. Thus, it is not unusual to require pumping at a rate of 15-20 barrels/minute to propel a tool at a recommended rate of 150-250'/minute. At 200'/minute it takes fifty minutes to pump a tool through a 10,000' horizontal leg. At a pump rate of 20 bpm, this is 1000 barrels.

When the tool 10 reaches the horizontal leg of a horizontal well, the weight of the tool 10 tends to compress the cup 48 on the weight bearing side of the tool 10 and move away from the casing interior on the non-weight bearing side. Three factors tend to mitigate the cup 48 from unsealing relative to the casing 40. First, the cup 48 may have considerable flexibility thereby allowing it to remain more-or-less engaged with the non-weight bearing side of the tool 10. Second, pressure from above, represented by the arrow 74, stiffens the cup 48 and pushes the lip 62 on the weight bearing side of the tool 10 toward the casing interior and thereby acts as a centralizer to center the tool 10 in the casing 40. Pressure from above also biases the non-weight bearing side of the lip 62 toward the casing interior keeping it in more-or-less sealing engagement ith the casing interior.

It will be seen that the resilient cup 48 prevents most of the liquid pumped into the casing 40 from passing around the tool 10 in an uncontrolled manner. This means that the tool can be pumped to its desired location in the well by pumping into the well a liquid volume substantially equal to the volume of the pipe string from the heel of the horizontal leg to its desired location. This volume is much smaller than is conventionally required. For example, consider a situation of a horizontal well having a 10,000' long lateral cased with 4½" O.D., N-80, 11.6 #/ft pipe having a nominal I.D. of 4.000 inches subject to normal manufacturing variations or tolerances. Casing of this size has a volume of 67 linear feet per barrel, so it would take a minimum of 10,000/67 or about 150 barrels of liquid to pump the tool 10 from the heel to the end of the horizontal lateral. This is much smaller than the volume of liquid needed to create a dynamic pressure drop across the tool and propel it 10,000'. To achieve a nominal 150-250'/minute rate of movement of the tool 10 inside the pipe string above, with perfect sealing of the resilient cup 48, it will be seen that a pump rate of 2.2-3.7 bpm is required—much less than the 15-20 bpm of the prior art.

In fact, it may be desirable to provide one or more small bypasses 70 may be provided around the resilient cup 48. Many of the tools 10 are used in conjunction with the fracing of hydrocarbon wells so it is not uncommon to find proppant, such as sand, accumulated in the horizontal leg of such a well. Providing one or more small bypasses around the resilient cup 48 allows a small stream of liquid to disperse any proppant accumulated in front of the tool 10 as it is propelled along the horizontal leg of the well. The bypasses 70 work by diverting part of the pumped liquid in a controlled manner through the lower end of the passage 13 and through a passage 72 in the anti-rotation device 24 as suggested by the arrow 76. This bypass liquid is sufficient to stir up and disperse any proppant in front of the tool 10 as it is being pumped along the horizontal leg of the well so the tool 10 doesn't have to plow its way through the accumulated proppant. Consequently, a pump rate of 6-9 bpm may be more typical of pump rates with the tool 10. Thus, to pump the tool 10 through a 10,000' horizontal leg may require 10-15 bpm less than with a prior art device. Manifestly, the smaller the bypass 70, the smaller the pumped volume but with less proppant dispersion—both of which are of importance. An optimum size for the bypass 70 is sufficient to barely disperse proppant collecting in the casing 40, the amount and concentration of which are unknown. Thus, the optimum size of the bypass 70 is normally unknowable and some compromise is in order.

Another advantage of the bypass 70 is that it allows the tool to be pulled from the well without swabbing the casing 40. Occasionally, something occurs which makes it desirable to remove the tool 10 from the well without setting it. The bypasses 70 allow the tool 10 to be pulled toward the surface and allow liquid in the casing 40 to pass from above the cup 48, through the bypass 70 and out the passage 72 without delivering liquid at the surface. Although the size and number of the bypasses 70 will differ depending on the size of the casing 40, the desired rate of pulling the tool 10 from the well and other factors, two passages of ⅜" diameter have been found to be sufficient with normal production sized casing, i.e. 4½" and 5½" O.D.

Figure 3:
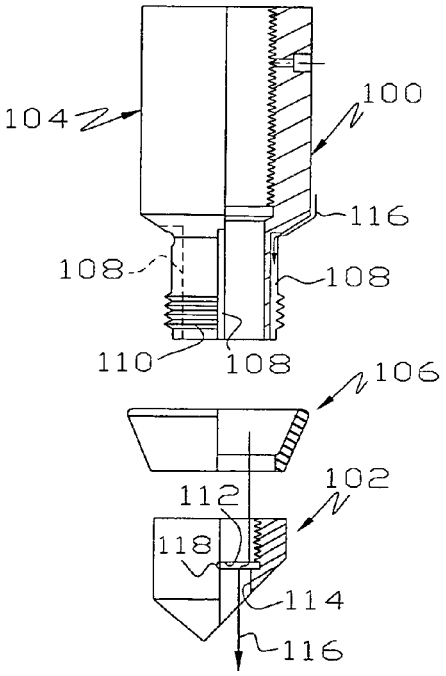
FIG. 3 is a view similar to FIG. 2 showing another embodiment of a resilient cup and support.

Referring to FIG. 3, another embodiment of this invention includes a tool 100 including an anti-rotation device 102 on the end of a body section 104. A resilient cup 106 of somewhat different configuration is captivated between the device 102 and the body section 104. One or more bypass channels 108 may be provided, either alone or in conjunction with a passage comparable to the passage 70. The channels 108 pass through threads 110 securing the anti-rotation device 102 to the lower body section 104. Thus, the threads 110 are interrupted threads but are still of sufficient capacity to secure the anti-rotation device 102 to the lower body section 104. It will be seen that the bypass channels 108 have the same function as the bypass 70 so a bypass stream flows through the channels 108, through a slot 112 in the anti-rotation device 102 and out of the bottom of the tool 100 through a passage 114 in the anti-rotation device 102 as suggested by the arrow 116. A set screw 118 may be provided in the anti-rotation device 102 to prevent it from unthreading from the body section 104. The cup 106 may be concave toward the upper end of its tool so that pressure applied from above may spread or enlarge the diameter of the cup 106 from a size approximating the diameter of its tool in its running in configuration to a size larger than the set diameter of the slips carried by the tool.

Although this invention has been described in its preferred forms with a certain degree of particularity, it is understood that the present disclosure of the preferred forms is only by way of example and that numerous changes in the details of operation and the combination and arrangement of parts may be resorted to without departing from the scope of the invention as hereinafter claimed.

I claim:

1. A pump down well tool to be run inside a horizontal leg of a well including a casing string, comprising a body having a first end and a second end, the first end including a connection to join with a work string to set the tool in the casing string;

at least one malleable element disposed about the body;

at least one slip disposed about the body;

at least one conical member disposed about the body, whereupon the conical member acts to radially advance the malleable element and slips from a running in configuration toward the casing string during setting of the tool; and a resilient cup disposed about the body having a concave side facing toward the first end, the cup being configured to abut an internal dimension of the casing string in the running in configuration when the tool is pumped into the casing string, the cup being configured to push the tool along a distance, away from earth's surface, in the horizontal leg of the well in response to a pumped volume substantially equal to the internal volume of the casing string along the distance pushed.

2. The pump down tool of claim 1 wherein at least some of the components of the tool are of composite materials.

3. The pump down tool of claim 1 further comprising an anti-rotation device adjacent the second end of the tool.

4. The pump down tool of claim 1 wherein the resilient cup is captivated between the anti-rotation device and the body.

5. The pump down tool of claim 1 wherein the resilient cup is captivated to the second end of the tool.

6. The pump down tool of claim 1 wherein the resilient cup is a swab cup.

7. The pump down tool of claim 1 further comprising a fluid bypass between the cup and the body, the fluid bypass being configured to allow the tool to be pulled from the well without swabbing the casing string.

8. The pump down tool of claim 7 wherein the fluid bypass is continuously open.

9. A pump down well tool to be run inside a horizontal leg of a well having a casing string having an internal diameter, comprising a body having a first end and a second end, the first end including a connection to join with a work string to set the tool in the casing string;

a slips/seal section movable on an exterior of the body from a running in position where an external dimension of the tool is less than the casing internal diameter to an expanded position where the external dimension of the tool is the same as the casing internal diameter for sealing against the casing string; and a resilient cup, separate from the slips/seal section, disposed about the body having a concave side facing toward the first tool end and a lip configured to abut the internal diameter of the casing string, the resilient cup being responsive to pressure applied from the first tool end to expand into engagement with the internal diameter of the casing string when the tool is pumped into the casing string, the cup being configured to push the tool along a distance, away from earth's surface, in the horizontal leg of the well in response to a pumped volume substantially equal to the internal volume of the casing string along the distance pushed.

10. The pump down tool of claim 9 wherein at least some of the components of the tool are of composite materials.

11. The pump down tool of claim 9 further comprising an anti-rotation device adjacent the second end of the tool.

12. The pump down tool of claim 9 wherein the resilient cup is captivated between the anti-rotation device and the body.

13. The pump down tool of claim 9 wherein the resilient cup is captivated to the second end of the tool.

14. The pump down tool of claim 9 wherein the resilient cup is a swab cup.

15. The pump down tool of claim 9 further comprising a fluid bypass between the cup and the body, the fluid bypass being configured to allow the tool to be pulled from the well without swabbing the casing string.

16. The pump down tool of claim 15 wherein the fluid bypass is continuously open.

17. A pump down well tool to be run inside a horizontal leg of a well having a casing string having an internal diameter, comprising a body having a first end and a second end, the first end including a connection to join with a work string to set the tool in the casing string;

a slips/seal section movable on an exterior of the body from a running in position where an external dimension of the tool is less than the casing internal diameter to an expanded position where the external dimension of the tool is the same as the casing internal diameter for sealing against the casing string;

a resilient cup, separate from the slips/seal section, disposed about the body having a concave side facing toward the first tool end and a lip configured to abut the internal diameter of the casing string, the resilient cup being responsive to pressure applied from the first tool end to expand into engagement with the internal diameter of the casing string when the tool is pumped into the casing string, the cup being configured to push the tool along a distance, away from earth's surface, in the horizontal leg of the well in proportion to a pumped volume related to the internal volume of the casing string along the distance pushed; and a fluid bypass between the cup and the body allowing liquid to pass between the first and second ends of the tool, the fluid bypass being configured to allow the tool to be pulled from the well without swabbing the casing string.

18. The pump down tool of claim 17 wherein the fluid bypass is continuously open.

* * * * *